US011125120B2

(12) United States Patent
Wang et al.

(10) Patent No.: US 11,125,120 B2
(45) Date of Patent: Sep. 21, 2021

(54) VALVE BRIDGE AND ENGINE COMPRISING THE VALVE BRIDGE

(71) Applicant: WEICHAI POWER CO., LTD., Shandong (CN)

(72) Inventors: Gang Wang, Shandong (CN); Jianming Tang, Shandong (CN)

(73) Assignee: WEICHAI POWER CO., LTD., Shandong (CN)

( * ) Notice: Subject to any disclaimer, the term of this patent is extended or adjusted under 35 U.S.C. 154(b) by 93 days.

(21) Appl. No.: 16/316,816

(22) PCT Filed: Nov. 18, 2016

(86) PCT No.: PCT/CN2016/106350

§ 371 (c)(1),
(2) Date: Jan. 10, 2019

(87) PCT Pub. No.: WO2018/036002

PCT Pub. Date: Mar. 1, 2018

(65) Prior Publication Data

US 2020/0182102 A1 Jun. 11, 2020

(30) Foreign Application Priority Data

Aug. 23, 2016 (CN) ..... 201610709066.7

(51) Int. Cl.
*F01L 1/26* (2006.01)
*F01L 13/06* (2006.01)

(52) U.S. Cl.
CPC ..... *F01L 1/26* (2013.01); *F01L 13/06* (2013.01)

(58) Field of Classification Search
CPC ..... F01L 1/181; F01L 13/06; F01L 13/065; F01L 1/26; F01L 2305/00; F01L 1/267;
(Continued)

(56) References Cited

U.S. PATENT DOCUMENTS 3,520,287 A * 7/1970 Calvin ..... F01L 13/06 123/321
4,327,677 A 5/1982 Vander Bok
(Continued)

FOREIGN PATENT DOCUMENTS

CN 101142380 A 3/2008
CN 202017535 U 10/2011
(Continued)

OTHER PUBLICATIONS

International Search Report corresponding to Application No. PCT/CN2016/106350; dated Jun. 2, 2017.
(Continued)

*Primary Examiner* — Patrick Hamo
*Assistant Examiner* — Wesley G Harris
(74) *Attorney, Agent, or Firm* — Cantor Colburn LLP

(57) ABSTRACT

A valve bridge has a valve bridge body being provided with a main piston chamber, an actuating pin mounting chamber, a main piston, and an actuating pin; an elastic member is arranged between the actuating pin and the actuating pin mounting chamber, and a lower end of the actuating pin extends out of the actuating pin mounting chamber under an elastic force of the elastic member; the valve bridge body is provided with a first oil drainage passage in communication with the main piston chamber, and an interior of the actuating pin is provided with a second oil drainage passage having one end in communication with a return oil chamber of an engine.

20 Claims, 2 Drawing Sheets

(58) Field of Classification Search
CPC ..... F01L 1/18; F01L 1/20; F01L 9/02; F01L 1/2411; F01L 1/2416; F02D 13/04
USPC ..... 123/90.16, 321, 90.12, 90.46, 90.55, 123/90.45
See application file for complete search history.

(56) References Cited

U.S. PATENT DOCUMENTS

| | | | | |
|---|---|---|---|---|
| 6,006,706 | A * | 12/1999 | Kanzaki | F01L 13/0031 123/90.15 |
| 6,386,160 | B1 | 5/2002 | Menelly et al. | |
| 8,225,769 | B2 * | 7/2012 | Dilly | F01L 1/26 123/321 |
| 8,578,901 | B2 * | 11/2013 | Ruggiero | F01L 1/2416 123/90.22 |
| 10,094,250 | B2 * | 10/2018 | Nair | F01L 1/146 |
| 2003/0079705 | A1 * | 5/2003 | Lutz | F01L 1/18 123/90.39 |
| 2005/0211206 | A1 | 9/2005 | Ruggiero et al. | |
| 2011/0079195 | A1 | 4/2011 | Dilly | |
| 2013/0319370 | A1 * | 12/2013 | Yang | F01L 13/0031 123/322 |

FOREIGN PATENT DOCUMENTS

| | | | | |
|---|---|---|---|---|
| CN | 102588027 | A | 7/2012 | |
| CN | 103835781 | A | 6/2014 | |
| CN | 104420908 | A | 3/2015 | |
| CN | 204386688 | U | 6/2015 | |
| CN | 105351026 | A | 2/2016 | |
| CN | 205089460 | U | 3/2016 | |
| CN | 106089348 | A | 11/2016 | |
| DE | 19858213 | A1 * | 6/2000 | F01L 1/24 |
| EP | 2305968 | A1 | 4/2011 | |
| WO | 2014015292 | A2 | 1/2014 | |

OTHER PUBLICATIONS

EPO Extended Search Report corresponding to EP Application No. 16914022.5; dated Feb. 28, 2020.

* cited by examiner

VALVE BRIDGE AND ENGINE COMPRISING THE VALVE BRIDGE

CROSS REFERENCE TO RELATED APPLICATIONS

This is the U.S. national stage of application No. PCT/CN2016/106350, filed on Nov. 18, 2016. Priority under 35 U.S.C. § 119(a) and 35 U.S.C. § 365(b) is claimed from Chinese Application No. 201610709066.7, filed Aug. 23, 2016, the disclosures of which are incorporated herein by reference.

FIELD

The present application relates to the technical field of engine accessories, specifically, relates to a valve bridge and an engine having the valve bridge.

BACKGROUND

When a car is running downhill and a driver starts an engine brake device, a fuel supply system stops supplying oil, and at the same time, when an engine approaches the top dead point of a compression stroke, an exhaust valve is driven by the engine brake device to be opened with a small lift amount (1~2 mm), which releases compressed high-pressure gas in cylinders rapidly and reduces the pressure in the cylinder rapidly. Therefore, in a subsequent power stroke, the engine basically does not produce mechanical work.

The valve bridge is installed at a top end of a corresponding valve and is used to transfer a force from a rocker arm, and to ensure that the corresponding valve is opened at the same time. When the engine works, with the rotation of a camshaft, the power is transferred through a tappet and a push rod, to drive the rocker arm to rotate around a rocker shaft, and then the rocker arm drives the valve bridge to open the valve.

A valve bridge in the conventional art is shown in FIG. 1, a piston chamber is arranged in the valve bridge at a brake valve end, and an actuating piston 1 is installed inside the piston chamber. An oil drain hole 2 is machined above the actuating piston 1, through which oil in the valve bridge is discharged.

During the braking process, since it is required to establish a hydraulic connection, a sealing device 3 is required to seal the hole.

When the engine is in a main exhaust stroke, the entire valve bridge moves downward, the valve bridge is disengaged from the sealing device 3, and the high-pressure oil in the valve bridge is discharged.

However, the current valve bridge needs to add a separate sealing device for the oil drain hole, which is apt to cause collision and wear between the sealing device and the valve bridge, and the layout is difficult, which affects the reliability of the engine.

Therefore, an important technical problem to be solved by the technicians in the field is how to avoid the collision and wear between the sealing device and the valve bridge, and the difficult layout of the sealing device.

SUMMARY

In view of this, a valve bridge is provided according to the present application, which can avoid the technical problems of the collision and wear between the sealing device and the valve bridge and the difficult layout of the sealing device. An engine having the valve bridge is further provided according to the present application.

The valve bridge provided by the present application includes a valve bridge body, the valve bridge body is provided with a main piston chamber, an actuating pin mounting chamber, a main piston arranged in the main piston chamber, and an actuating pin arranged in the actuating pin mounting chamber; an elastic member is arranged between the actuating pin and the actuating pin mounting chamber, and a lower end of the actuating pin extends out of the actuating pin mounting chamber under an elastic force of the elastic member; the valve bridge body is provided with a first oil drainage passage in communication with the main piston chamber, and an interior of the actuating pin is provided with a second oil drainage passage having one end in communication with a return oil chamber of an engine; and when a camshaft of the engine is in a main exhaust lift and drives the valve bridge to move downward, the actuating pin comes into contact with a cylinder head and pushes the actuating pin to move upward, and before reaching a maximum valve lift, the first oil drainage passage is in communication with the second oil drainage passage to release pressure oil in the main piston.

Preferably, a limiting protrusion is arranged on the cylinder head of the engine, and the actuating pin comes into contact with the limiting protrusion when the camshaft of the engine is in the main exhaust lift and drives the valve bridge to move downward.

Preferably, the actuating pin is in a clearance fit with the actuating pin mounting hole.

Preferably, the actuating pin is configured as a stepped structure with an upper part being a large diameter part and a lower part being a small diameter part and having a diameter smaller than a diameter of the upper part, and a lower opening of the actuating pin mounting hole is greater than the diameter of the small diameter part and smaller than the diameter of the large diameter part.

Preferably, a lower end of the actuating pin mounting hole is fixed with a fixing gasket through screws, and the fixing gasket is provided with a through hole to form the lower opening of the actuating pin mounting hole.

Preferably, the elastic member is a spring abutting against an upper end of the actuating pin mounting hole and an upper end of the actuating pin.

Preferably, the upper end of the actuating pin mounting hole is provided with a spring seat for mounting the spring.

Preferably, the valve bridge body is further provided with an auxiliary piston chamber, and an auxiliary piston is arranged in the auxiliary piston chamber, and the valve bridge body is provided with a pressure oil passage for communicating an upper part of the auxiliary piston chamber with the main piston chamber.

An engine having a valve bridge is further provided according to the present application, and the valve bridge is the valve bridge in any one of the above solutions.

In the technical proposal provided by the present application, when the engine produces a positive work, a solenoid valve is turned off and a brake oil circuit does not work, and when the engine needs to be braked, the brake oil circuit is opened. At this point, lubricant flows on to the main piston of the valve bridge. Under the action of the oil pressure, the main piston overcomes the spring force, the spring is compressed, and the brake pressure oil enters the main piston chamber. When the camshaft rotates to a brake lift, the rocker arm is driven to rotate to further drive the main piston to move downward, thus opening the brake valve, discharging the compressed gas out of the cylinder and releasing the energy, thereby realizing the engine brake.

It should be noted that when the camshaft is in the main exhaust lift and drives the valve bridge to move downward, the actuating pin can come into contact with the cylinder head and push the actuating pin to move upward, and before reaching the maximum valve lift, the first oil drainage passage is in communication with the second oil drainage passage to discharge the pressure oil in the main piston.

In this way, the technical solution provided by the present application does not require a sealing device to seal the hydraulic pressure in the valve bridge or to relieve the pressure, and can also realize the engine brake and allow the engine to work normally to output power, thereby avoiding the technical problems of the collision and wear between the sealing device and the valve bridge caused by providing the sealing device, and the difficult placement of the sealing device.

BRIEF DESCRIPTION OF THE DRAWINGS

In order to more clearly illustrate the embodiments of the present application or the technical proposal in the conventional art, the accompanying drawings used in the embodiments or the description of the conventional art are briefly introduced hereinafter. Obviously, the accompanying drawings described hereinafter are only several embodiments of the present application, and for those skilled in the art, other accompanying drawings may also be obtained according to these accompanying drawings without any creative work.

Figure 1:
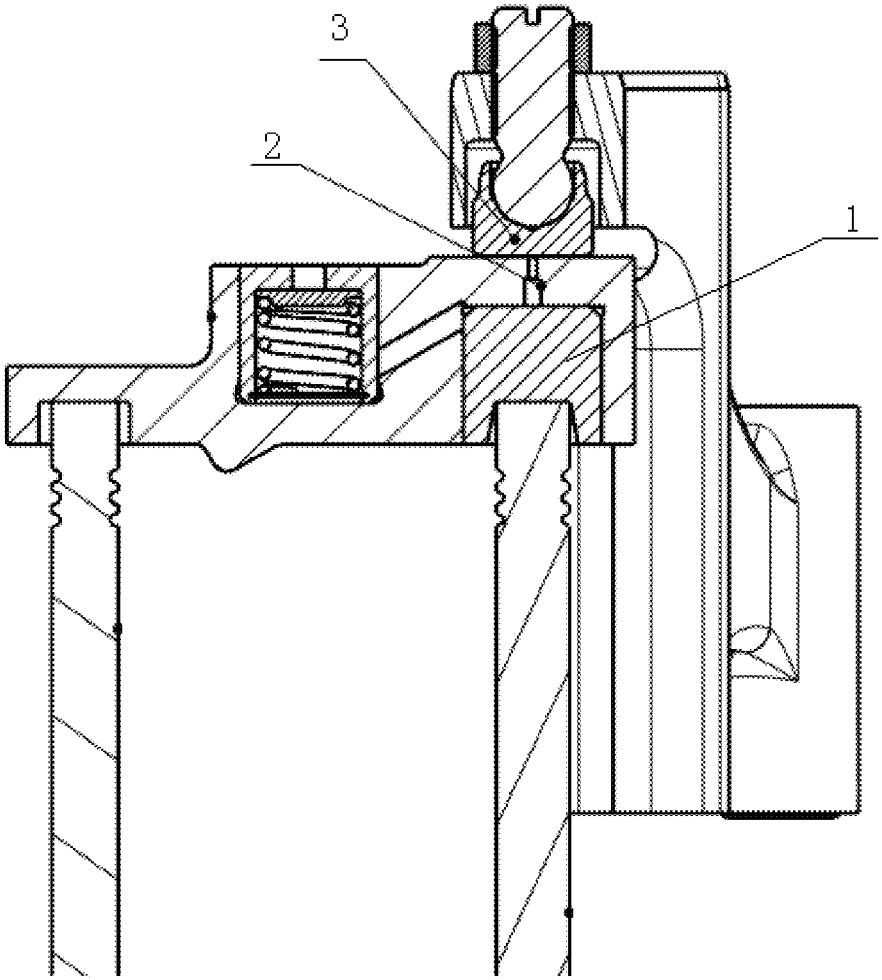
FIG. 1 is a schematic view of a valve bridge in the conventional art.
Figure 2:
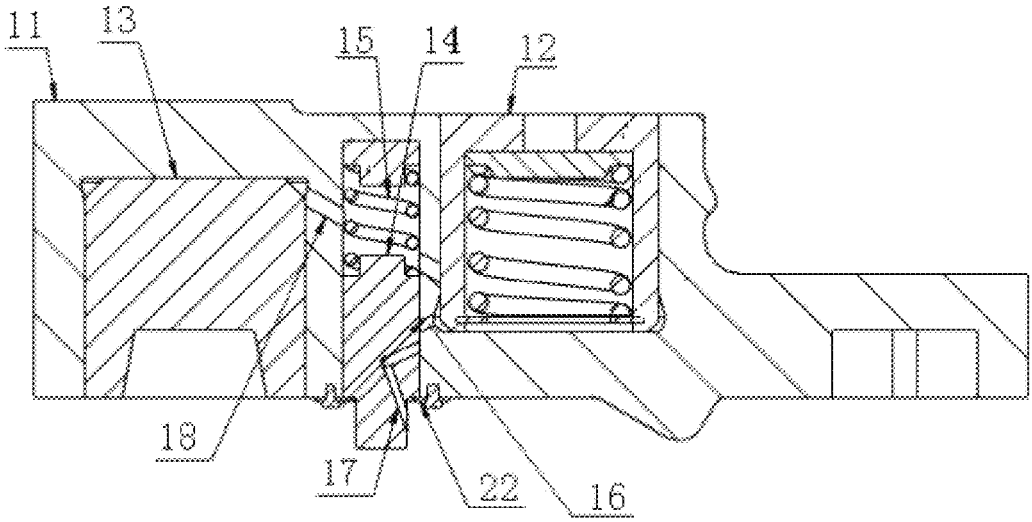
FIG. 2 is an internal schematic view of a valve bridge according to an embodiment of the present application.
Figure 3:
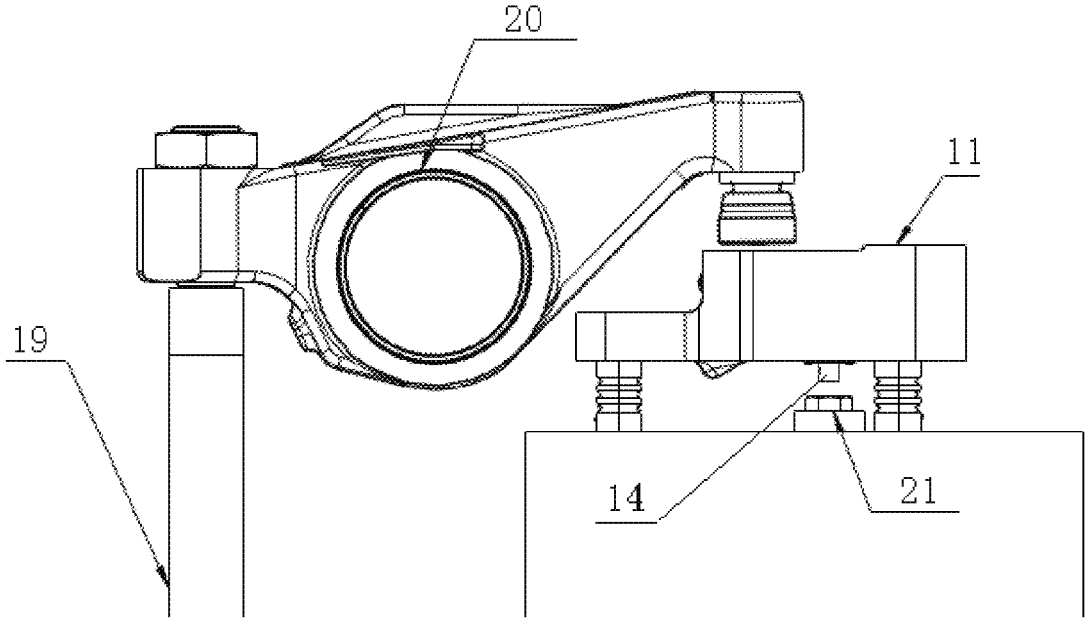
FIG. 3 is a schematic view showing the cooperation between the valve bridge and a rocker arm according to an embodiment of the present application.

Reference Numerals in FIG. 2 and FIG. 3:

| | |
|---|---|
| valve bridge body - 11, | main piston - 12, |
| auxiliary piston - 13, | actuating pin - 14, |
| elastic member - 15, | first oil drainage passage - 16, |
| second oil drainage passage - 17, | pressure oil passage - 18, |
| push rod - 19, | rocker arm - 20, |
| limiting protrusion - 21, | fixing gasket - 22. |

DETAILED DESCRIPTION OF EMBODIMENTS

A valve bridge provided according to this embodiment can avoid the technical problems of the collision and wear between a sealing device and the valve bridge, and the difficult placement of the sealing device. An engine having the valve bridge is also provided according to this embodiment.

The following examples are illustrated with reference to the accompanying drawings. Furthermore, the following examples do not constitute any limit on the content of the application described in the claims. In addition, the entire content illustrated in the following embodiments is not limited to the content which is necessary to the solution to the application as described in the claims.

Referring to FIG. 2 and FIG. 3, the valve bridge in this embodiment includes a valve bridge body 11, and a main piston 12 for controlling the opening or closing of a valve is provided on the valve bridge body 11. Of course, in order to control multiple valves at the same time, an auxiliary piston 13 can also be installed on the valve bridge body 11. In order to achieve synchronous control, a main piston chamber for installing the main piston 12 is preferably in communication with an upper part of an auxiliary piston chamber for installing the auxiliary piston 13 through a pressure oil passage 18. When the main piston 12 is filled with pressure oil, the pressure oil enters the auxiliary piston chamber through the pressure oil passage 18 at the same time, to further control the motion of the auxiliary piston 13, thereby controlling the multiple valves at the same time.

In this embodiment, the valve bridge body 11 is also provided with an actuating pin mounting chamber and an actuating pin 14 arranged in the actuating pin mounting chamber.

An elastic member 15 is arranged between the actuating pin 14 and the actuating pin mounting chamber. Under an elastic force of the elastic member 15, a lower end of the actuating pin 14 extends out of the actuating pin mounting chamber. The valve bridge body 11 is provided with a first oil drainage passage 16 in communication with the main piston chamber, and an interior of the actuating pin 14 is provided with a second oil drainage passage 17 having one end in communication with a return oil chamber of the engine.

When a camshaft of the engine is in a main exhaust lift and drives the valve bridge to move downward, the actuating pin 14 comes into contact with a cylinder head, thus the actuating pin 14 is pushed upward, and before reaching the maximum valve lift, the first oil drainage passage 16 is in communication with another end of the second oil drainage passage 17 to discharge the pressure oil from the main piston 12.

It should be noted that, in this embodiment, when the engine is working, with the rotation of the camshaft, the power can be transferred through a tappet (not shown in the figure) and a push rod 19, to drive the rocker arm 20 to rotate around a rocker arm axis, and the rocker arm 20 drives the valve bridge to open the valve.

When the engine produces a positive work, a brake oil circuit does not work, and when the engine needs to be braked, the driver presses a brake start button, a solenoid valve is energized, and the brake oil circuit is opened. At this point, lubricant travels along an oil path within the rocker arm 20 into the main piston chamber of a valve bridge assembly in contact with the rocker arm 20. At this time, the oil pressure overcomes the spring force in the main piston 12, the spring is compressed, and the brake pressure oil enters the main piston chamber. After the entire main piston chamber is filled with the brake pressure oil, the entire main piston 12 floats upward, and at the same time, the pressure oil passes through the pressure oil passage 18 in the valve bridge body 11 to enter the upper part of the auxiliary piston chamber. Since there is a certain gap preserved between the rocker arm 20 and the valve bridge during installation, the main piston 12 floats upward and drives the rocker arm 20 to rotate counter-clockwise until the gap is cleared, at this time, the main piston and the auxiliary piston 13 of the valve bridge are connected through the pressure oil. When the camshaft rotates to a brake lift, the rocker arm 20 is driven to rotate clockwise and the main piston 12 moves downward, and since the hydraulic connection can be considered as a rigid connection, the downward movement of the main piston 12 will drive the auxiliary piston 13 to move downward, thus opening the brake valve, discharging the compressed gas out of the cylinder and releasing the energy, thereby realizing the engine brake.

When the camshaft is in the main exhaust lift, the rocker arm 20 drives the main piston 12 to move downward, thus driving the whole valve bridge to move downward. At this time, a limiting protrusion 21 on the cylinder head comes into contact with the actuating pin 14 and pushes the actuating pin 14 to move upward, and before reaching the maximum valve lift, the first oil drainage passage 16 and the second oil drainage passage 17 are in communication with each other, and the pressure oil flows out of the first oil drainage passage 16 and the second oil drainage passage 17 to realize the oil drainage function, which ensures that the brake exhaust valve lift is the same as the non-brake exhaust valve lift under the braking condition.

In this embodiment, a lower end of the valve bridge body 11 is machined with the actuating pin mounting hole used to install the actuating pin 14, and the actuating pin 14 moves up and down vertically. Considering the thermal expansion caused by friction, the side surface of the actuating pin 14 should be designed to cooperate with the actuating pin mounting hole in a clearance fit, so as to avoid the abrasion of the valve bridge body 11 and the actuating pin 14 caused by an excessive temperature generated by friction, which may affect the normal work. The actuating pin 14 moves up and down vertically and is in constant contact with the limiting protrusion 21 and rubs against the limiting protrusion 21, therefore, the actuating pin 14 needs to have a high hardness to ensure its wear resistance, and usually, the entire actuating pin 14 is quenched.

In addition, in order to install the limit pin reliably in the limit pin mounting hole, the actuating pin 14 is preferably configured as a stepped structure with an upper part being a large diameter part and a lower part being a small diameter part having a diameter smaller than the diameter of the upper part. A diameter of a lower opening of the actuating pin mounting hole is greater than the diameter of the small diameter part and smaller than the diameter of the large diameter part.

In order to facilitate installation, the lower end of the actuating pin mounting hole is fixed with a fixing gasket 22 by screws, and the fixing gasket 22 is provided with a through hole to form the lower opening of the actuating pin mounting hole.

It should also be noted that the elastic member 15 installed between the actuating pin 14 and the actuating pin mounting hole can be specifically a spring abutting against the upper end of the executing pin mounting hole and the upper end of the actuating pin 14. Specifically, in order to facilitate installation, a spring seat for mounting the spring can be arranged at the upper end of the actuating pin mounting hole.

An engine having a valve bridge is provided according to an embodiment, and the valve bridge is the valve bridge as described in the above embodiments. In this way, the engine provided in this embodiment can avoid the technical problems of the collision and wear between the sealing device and the valve bridge, and the difficult placement of the sealing device. The deducing process of the beneficial effect of the engine is similar to that of the valve bridge in the above embodiments, which will not be repeated herein.

According to the above description of the disclosed embodiments, those skilled in the art can implement or use the present application. Many modifications to these embodiments are apparent for those skilled in the art, and general principles defined herein may be implemented in other embodiments without departing from the spirit or scope of the present application. Hence, the present application is not limited to the embodiments disclosed herein, but should be defined by the broadest scope consistent with the principle and novel features disclosed herein.

The invention claimed is:

1. A valve bridge, comprising:

a valve bridge body, wherein the valve bridge body is provided with a main piston chamber, an actuating pin mounting chamber, a main piston arranged in the main piston chamber, and an actuating pin arranged in the actuating pin mounting chamber; an elastic member is arranged between the actuating pin and the actuating pin mounting chamber, and a lower end of the actuating pin extends out of the actuating pin mounting chamber under an elastic force of the elastic member; the valve bridge body is provided with a first oil drainage passage in communication with the main piston chamber, and an interior of the actuating pin is provided with a second oil drainage passage; and wherein, when a camshaft of an engine is in a main exhaust lift and drives the valve bridge to move downward, the actuating pin comes into contact with a cylinder head and pushes the actuating pin to move upward, and before reaching a maximum valve lift, the first oil drainage passage is in communication with the second oil drainage passage to release pressure oil in the main piston chamber; and wherein the first oil drainage passage is a through hole provided inside the valve bridge body and having two end ports, one end port of the two end ports of the first oil drainage passage is located at a wall of the main piston chamber, and an other end port of the two end ports of the first oil drainage passage is located at a side wall of the actuating pin mounting chamber; and the actuating pin is configured as a stepped structure with an upper part being a large diameter part and a lower part being a small diameter part and having a diameter smaller than a diameter of the upper part; the second oil drainage passage is a through hole provided inside the actuating pin and having two end ports, one end port of the two end ports of the second oil drainage passage is located at an outer wall of the large diameter part of the actuating pin, and an other end port of the two end ports of the second oil drainage passage is located at an outer wall of the small diameter part of the actuating pin and in communication with a return oil chamber of the engine.

2. The valve bridge according to claim 1, wherein a limiting protrusion is arranged on the cylinder head of the engine, and the actuating pin comes into contact with the limiting protrusion when the camshaft of the engine is in the main exhaust lift and drives the valve bridge to move downward.

3. An engine, having a valve bridge, wherein the valve bridge is the valve bridge according to claim 2.

4. The valve bridge according to claim 2, wherein the valve bridge body is further provided with an auxiliary piston chamber, and an auxiliary piston is arranged in the auxiliary piston chamber, and the valve bridge body is provided with a pressure oil passage for communicating an upper part of the auxiliary piston chamber with the main piston chamber.

5. The valve bridge according to claim 1, wherein the actuating pin is in a clearance fit with the actuating pin mounting chamber.

6. An engine, having a valve bridge, wherein the valve bridge is the valve bridge according to claim 5.

7. The valve bridge according to claim 5, wherein the valve bridge body is further provided with an auxiliary piston chamber, and an auxiliary piston is arranged in the auxiliary piston chamber, and the valve bridge body is provided with a pressure oil passage for communicating an upper part of the auxiliary piston chamber with the main piston chamber.

8. The valve bridge according to claim 1, wherein a lower opening of the actuating pin mounting chamber is greater than the diameter of the small diameter part and smaller than the diameter of the large diameter part.

9. The valve bridge according to claim 8, wherein a lower end of the actuating pin mounting chamber is fixed with a fixing gasket through screws, and the fixing gasket is provided with a through hole to form the lower opening of the actuating pin mounting chamber.

10. An engine, having a valve bridge, wherein the valve bridge is the valve bridge according to claim 9.

11. The valve bridge according to claim 9, wherein the valve bridge body is further provided with an auxiliary piston chamber, and an auxiliary piston is arranged in the auxiliary piston chamber, and the valve bridge body is provided with a pressure oil passage for communicating an upper part of the auxiliary piston chamber with the main piston chamber.

12. An engine, having a valve bridge, wherein the valve bridge is the valve bridge according to claim 8.

13. The valve bridge according to claim 8, wherein the valve bridge body is further provided with an auxiliary piston chamber, and an auxiliary piston is arranged in the auxiliary piston chamber, and the valve bridge body is provided with a pressure oil passage for communicating an upper part of the auxiliary piston chamber with the main piston chamber.

14. The valve bridge according to claim 1, wherein the elastic member is a spring abutting against an upper end of the actuating pin mounting chamber and an upper end of the actuating pin.

15. The valve bridge according to claim 14, wherein the upper end of the actuating pin mounting chamber is provided with a spring seat for mounting the spring.

16. The valve bridge according to claim 15, wherein the valve bridge body is further provided with an auxiliary piston chamber, and an auxiliary piston is arranged in the auxiliary piston chamber, and the valve bridge body is provided with a pressure oil passage for communicating an upper part of the auxiliary piston chamber with the main piston chamber.

17. An engine, having a valve bridge, wherein the valve bridge is the valve bridge according to claim 14.

18. The valve bridge according to claim 14, wherein the valve bridge body is further provided with an auxiliary piston chamber, and an auxiliary piston is arranged in the auxiliary piston chamber, and the valve bridge body is provided with a pressure oil passage for communicating an upper part of the auxiliary piston chamber with the main piston chamber.

19. The valve bridge according to claim 1, wherein the valve bridge body is further provided with an auxiliary piston chamber, and an auxiliary piston is arranged in the auxiliary piston chamber, and the valve bridge body is provided with a pressure oil passage for communicating an upper part of the auxiliary piston chamber with the main piston chamber.

20. An engine, having a valve bridge, wherein the valve bridge is the valve bridge according to claim 1.

* * * * *